US005200974A

United States Patent [19]

Kark et al.

[11] Patent Number: 5,200,974

[45] Date of Patent: Apr. 6, 1993

[54] ELECTRODE CARRIER ARM FOR AN ELECTRIC ARC FURNACE

[75] Inventors: Uwe Kark, Hamburg; Karl-Heinz Klein, Kehl, both of Fed. Rep. of Germany

[73] Assignee: Badische Stahl Engineering GmbH, Kehl, Fed. Rep. of Germany

[21] Appl. No.: 536,558

[22] PCT Filed: May 2, 1989

[86] PCT No.: PCT/EP89/00480

§ 371 Date: Sep. 7, 1990

§ 102(e) Date: Sep. 7, 1990

[87] PCT Pub. No.: WO89/11203

PCT Pub. Date: Nov. 16, 1989

[30] Foreign Application Priority Data

May 2, 1988 [DE] Fed. Rep. of Germany ..... 8805807

[51] Int. Cl.[5] ..... H05B 7/10

[52] U.S. Cl. ..... 373/94; 373/95; 373/96; 373/100; 373/101; 373/52

[58] Field of Search ..... 373/99, 94, 95, 96, 373/100, 52, 53, 101

[56] References Cited

U.S. PATENT DOCUMENTS

| | | | |
|---|---|---|---|
| 2,133,329 | 10/1938 | Moore et al. | 373/94 |
| 2,148,834 | 2/1939 | Payne | 373/99 |
| 2,386,260 | 10/1945 | Payne | 373/94 |
| 2,494,775 | 1/1950 | Moore | 373/99 |
| 2,538,603 | 1/1951 | Thys | 373/94 |
| 2,623,080 | 12/1952 | Young | 373/99 |
| 3,433,878 | 3/1969 | Sundberg et al. | 373/103 |
| 3,444,305 | 5/1969 | Turner | 373/95 |
| 3,602,624 | 8/1971 | Turner | 373/99 |
| 3,686,421 | 8/1972 | Wunsche et al. | 373/99 |
| 4,182,927 | 1/1980 | Phillips | 373/99 |
| 4,385,391 | 5/1983 | Hillers et al. | 373/99 |
| 4,670,884 | 6/1987 | Letizia et al. | 373/101 |
| 4,682,341 | 7/1987 | Ehle et al. | 373/99 |

FOREIGN PATENT DOCUMENTS

| | | |
|---|---|---|
| 0184140 | 6/1986 | European Pat. Off. . |
| 1336823 | 9/1963 | France . |

*Primary Examiner*—Bruce A. Reynolds
*Assistant Examiner*—Tu Hoang
*Attorney, Agent, or Firm*—Chilton, Alix & Van Kirk

[57] ABSTRACT

An electrode carrier arm for an electric arc furnace consists of an arm part (10) and of a electrode-clamping device and is produced so as to be current carrying from a material of high conductivity. Between the arm part and the electrode-clamping device there is a flanged connection consisting of flanged plates (11, 12) which limit a cooling-liquid cavity (20, 29) on both sides and which themselves contain passage orifices (21) for the cooling liquid from one cooling-liquid cavity to the other. This allows an effective cooling of the flanged plates and consequently a direct supply of current via the flanged connection when the carrier arm is produced from light metal.

9 Claims, 1 Drawing Sheet

ELECTRODE CARRIER ARM FOR AN ELECTRIC ARC FURNACE

Figure 1:
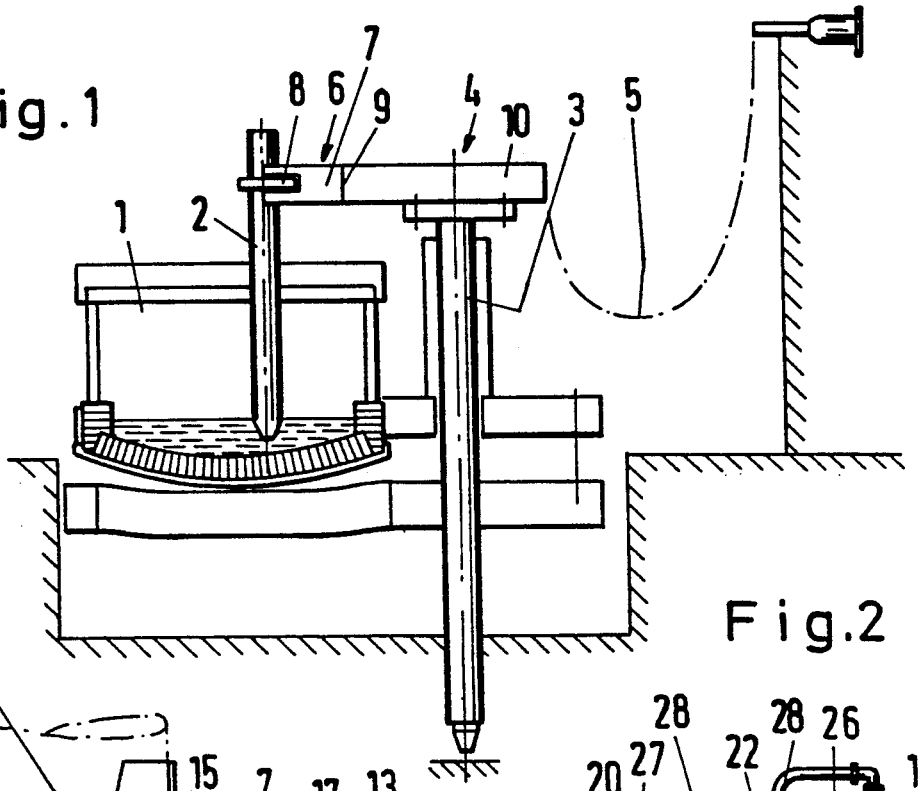

The electrodes of arc furnaces for steel production are held by carrier arms which at the end have an electrode-clamping device and which are themselves held on supporting columns allowing vertical adjustment. Cooling-water conveying devices are provided for cooling the electrode holder and the arm itself. For supplying current to the electrodes, the carrier arms mostly used in practice have high-current lines provided separately on the carrier arms. Since these involve a considerable outlay in production and maintenance terms, it has also been proposed to produce the entire carrier arm from copper and make it current-carrying (U.S. Pat. No. -A-2,494,775). The carrier arm is made hollow and closed off at the front end by means of a flanged plate which serves for flanged connection to the electrode-clamping device. Some of the current fed to the clamping device is also conveyed via the flanged connection. The cooling liquid is fed to the clamping device from the cooling-liquid cavity provided inside the carrier arm via outer pipes and passed the flanged connection. It is not yet known whether such an electrode carrier arm is successful in practice; at least where larger furnaces are concerned, the adverse ratio between the strength and weight of copper as the material of the carrier arm seems to be highly unfavourable.

This defect is remedied by another known construction (EP-A-0,184,140), in which the carrier arm consisting of steel is plated on the outside with copper or aluminium. This involves a very high outlay. At the end, the arm, including its cooling-liquid cavity, is limited by a flanged plate which serves for flanged connection to a contact jaw of the clamping device, it also being intended for the current to be supplied via this flanged connection. In practice, however, this construction is designed with a separate current connection, bypassing the flanged connection, from the copper plating of the carrier arm to the contact jaw, and it can be concluded from this that the current supply via the flanged connection presents problems, even when copper is used; in particular, it is not possible to guarantee an absolutely uniform large-surface transition contact in the flanged connection, and therefore local overheating can occur and quickly lead to destruction.

In yet another known electrode carrier arm (FR-A-1,336,823), therefore, the carrier arm current-carrying as a whole and produced from aluminium is not connected to the electrode-clamping device via a flanged connection, but the end plate limiting the carrier arm at the end is welded to the sectional parts forming the clamping device. This avoids the problems of contact-current transfer in the region of a flanged connection. A disadvantage, however, is that the clamping device cannot be released from the carrier arm. In the known instance, this may be acceptable because the power and therefore also the generation of heat and maintenance requirement are low.

The object on which the invention is based is to provide an electrode carrier arm, which involves a lower outlay than a steel arm plated with copper or aluminium and which allows a releasable current-carrying flanged connection between the arm part and the electrode-clamping device.

The solution according to the invention lies in an electrode carrier arm for an electric arc furnace comprising a current-carrying arm part made from a material of high conductivity and having an internal cavity for the circulation of cooling liquid. The current-carrying electrode clamping device is made from a material of high conductivity and has an interior cavity for the circulation of cooling liquid. A current-carrying flanged connection is between the cavity of the arm part and the cavity of the clamping device. The flanged connection includes orifices for the passage of cooling water between the cavity of the arm part and the cavity of the clamping device.

Producing the arm from light metal makes it possible to do without a steel case, whilst at the same time ensuring sufficient stability.

As used herein, "light metal" includes aluminum and various aluminum alloys such as Al Mg 4,5 Mn. According to the invention, the problems arising in the current-carrying flange region as a result of the tendency of the light metal to oxidation, especially at a higher temperature, and its susceptibility to burn-off in the event of insufficient touch contact are avoided because the flanged connection is cooled especially intensively as a result of its immediate proximity to the coolant cavity and by means of the passage orifices carrying cooling water. Consequently, local overheating cannot occur to a dangerous extent. Furthermore, the cooling-water passage orifices additionally ensure a simplification of construction, because outer connecting pipes are avoided.

Appropriately, not only on the same side as the arm part, but also on the same side as the electrode-clamping device, the flanged connection is formed by a flanged plate which consists of light metal and which participates in forming the cooling-liquid cavity of the corresponding part of the electrode-clamping device. In particular, this ensures ratios symmetrical on both sides of the flanged connection and reduces the danger that the components participating in the flanged connection will warp under the changing influence of temperature and those surface portions of the flange surfaces effectively in current-carrying contact with one another will be capable of undergoing variation.

For the electrode clip formed by the electrode-clamping device there must be actuating members which generally consist of a tension rod, a spring assembly and a hydraulic releasing device. According to the invention, these are accommodated between the flanged connection and the electrode clip in a further arm portion belonging to the electrode-clamping device. The advantage of this is that, by changing the electrode-clamping device, the actuating members can also be exchanged.

For the cooling-water circuit of the arm, several passage orifices can be provided in the flanged connection in accordance with the cooling requirement of the flanged connection. The cooling effect is increased further if, in the flanged connection, there are also passage orifices for the cooling-water supply of the clamping bracket, which can otherwise consist of pipelines or hose lines which are partially laid outside the arm or, according to an expedient alternative version of the invention, run through a clamping-bracket tension rod belonging to the actuating members of the electrode clip.

Figure 2:
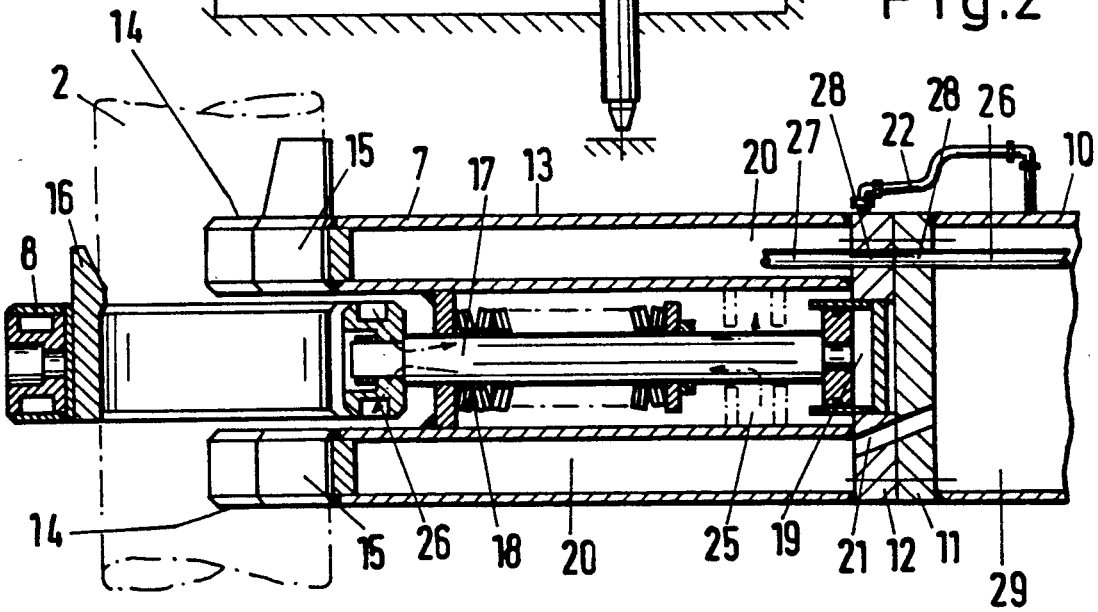
Figure 3:
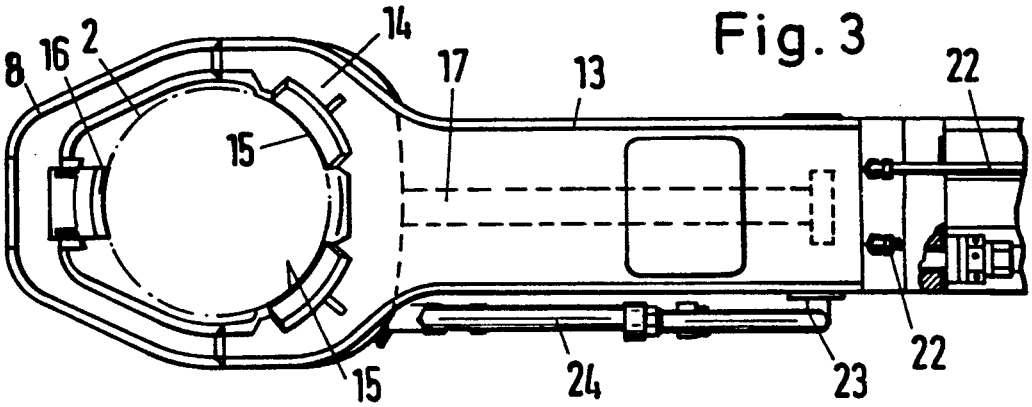

The invention is explained in detail below with reference to the drawing which illustrates an advantageous exemplary embodiment. In the drawing: FIG. 1 shows a side view of the apparatus, FIG. 2 shows, a vertical longitudinal section through the front part of the carrier arm, and FIG. 3 shows a top view of the front part of the carrier arm, FIG. 1 shows the known arrangement of an electric furnace 1, of the three electrodes of which one electrode 2 is shown. For each electrode there is a holding arrangement which consists of a vertically adjustable supporting column 3, of a carrier arm 4 fastened to this and of a feed arrangement 5 for current and cooling water. The carrier arm 4 comprises a rear arm part 10 and the electrode-clamping device 6 consisting of a part 7 fixed to the arm and of a clamping bracket 8. Where the invention is concerned, the electrode-clamping device can be separated from the arm part 10 located behind it by means of the flanged connection 9.

According to the invention, the carrier arm 4, at least its part 10 and preferably also its part 7, consists carrying.

The arm part 10 is designed as an internally ribbed hollow body which is filled with cooling water and which forms two cooling-water paths for the purpose of circulation. It terminates at the front at a flanged plate 11, to which the corresponding flanged plate 12 of the electrode holder 6 is screwed to form the flanged connection 9. The contact surface of these flanged plates is designed as a current-transfer surface. The flanged plates 11, 12 are part of the arm part 10 or of the part 7 fixed to the arm and therefore, like these, consist of aluminium or an aluminium alloy.

That part of the electrode-clamping device fixed to the arm consists of the elongated arm portion 13 continuing the arm part 10 and of a forking part 14 having the contact jaws 15 which bear against the electrode in order to hold the latter and form a lowresistance current transfer. The clamping bracket of the electrode holder is made annularly continuous with a pressure jaw 16 and, in order to generate the holding tension, is pulled rearwards by a tension rod 17 under the effect of a spring-plate assembly 18. By means of a hydraulic piston-cylinder arrangement 19, the spring assembly can be compressed and the clamping bracket pushed forwards in order to change the electrode. The part 7 fixed to the arm and the clamping bracket 8 of the electrode holder 6 are made hollow in a known way in order to receive cooling water.

Whilst the carrying parts of the part 7 fixed to the arm consist of aluminium and are current-carrying, the clamping bracket 8 can be produced in the conventional way, for example from alloyed steel.

The cooling-water cavities 20 of that part 7 of the electrode-clamping device fixed to the arm are connected to the cooling-water cavities 29 of the arm part 10 via cooling-water passage orifices, one of which is illustrated at 21 in FIG. 2, so that a continuous path through these parts is obtained for the circulation of the cooling water. Arranging the cooling-water passage orifices 21 in the flanged plates 11, 12 simplifies the exchange of the electrode-clamping device and cools the flanged plates. In contrast, the hydraulic lines 22 belonging to the piston-cylinder device 19 run outside the flanged connection.

For supplying cooling water to the clamping bracket 8, inside the arm part 10 there are pipelines and in the flanged plates 11, 12 there are mutually adjacent passage orifices leading to outer pipe connections 23 which are connected in a known way to the clamping bracket via hoses 24. These outer pipe connections can be avoided if the tension rod 17 is designed for carrying the cooling water. For this purpose, as indicated by dot-and-dash lines in FIG. 2, there can be a transition chamber 25 which is divided into a feed part and a discharge part and which is connected in a way not shown to cooling-water feed and discharge pipes. The walls of the chamber 25 are brought close to the surface of the tension rod 17. The tension rod 17 contains two longitudinal channels which open respectively as feed and discharge orifices into the chamber 25 and which are connected, at the front end of the tension rod 17, to the cooling-water cavities 26 of the clamping bracket 8, so that the flow path indicated by dot-and-dash arrows in FIG. 2 can be obtained.

In the version illustrated, the contact jaws 15 are connected in one piece to the electrode holder, that is to say are welded firmly to it, or are parts of the walls of the forks 14 located on the same side as the electrode. Since these walls are cooled effectively, even on the outer surface, by means of inset cooling-water channels and because of the high thermal conductivity of aluminium, this can ensure a substantial simplification in relation to conventional releasable contact jaws. But even when, in conjunction with the invention, the contact jaws are designed as separate releasable parts, there is still a simplification because there is no need for insulation between these and the forked parts 14.

We claim:

1. An electrode carrier arm for an electric are furnace, comprising:
   - a current-carrying arm part made from a light metal material of high conductivity and having an internal cavity for circulation of cooling liquid;
   - a current-carrying electrode clamping device made from a material of high conductivity and having an interior cavity for the circulation of cooling liquid;
   - a current carrying, flanged connection between the interior cavity of the arm part and the interior cavity of the clamping device, the flanged connection including a first flange plate forming a boundary of the interior cavity of the arm part, a second flange plate abutting and removably secured to the first flange plate and forming a boundary of the interior cavity of the clamping device, whereby said first and second flange plates provide a current transmission path from the arm part to the clamping device, said current carrying, flanged connection further including orifices in registry through said first and second flange plates for the passage of cooling liquid between the interior cavity of the arm part and the interior cavity of the clamping device.

2. Electrode carrier arm according to claim 1 wherein one part of the electrode-clamping device is adjacent to the flanged connection and consists of light metal material, another part of the electrode-clamping device includes a clamping bracket remote from the flanged connection, and all the current from the arm part passes through said first and second flange plates into said one part of the clamping device.

3. Electrode carrier arm according to claim 1, wherein the electrode-clamping device comprises an electrode clip, and an arm portion which is arranged between the flanged connection and the electrode clip, and which contains actuating members for the electrode clip.

4. Electrode carrier arm according to claim 3, wherein the electrode clip comprises a contact jaw connected to the arm portion, and a clamping bracket connected to the actuating members, and means for electrically insulating the clamping bracket and the actuating members relative to the arm portion.

5. Electrode carrier arm according to claim 4, wherein the clamping bracket has a liquid cooling circuit and the flanged connection contains passage orifices in fluid communication with the clamping-bracket cooling circuit.

6. Electrode carrier arm according to claim 5, wherein the actuating members actuate the clamping bracket by an actuating rod situated in the arm portion, and liquid cooling flow to and from the clamping bracket runs inside the arm portion.

7. Electrode carrier arm according to claim 2, wherein the electrode-clamping device comprises an electrode clip, and an arm portion which is arranged between the flanged connection and the electrode clip, and which contains actuating members for the electrode clip.

8. Electrode carrier arm according to claim 7, wherein the electrode clip comprises a contact jaw connected to the arm portion and a clamping bracket connected to the actuating members, and means for electrically insulating the clamping bracket and the actuating members relative to the arm portion.

9. Electrode carrier arm according to claim 8, wherein the clamping bracket has a liquid cooling circuit and the flanged connection contains passage orifices in fluid communication with the clamping-bracket cooling circuit.

* * * * *